United States Patent [19]

Nemoto et al.

[11] 4,252,867

[45] Feb. 24, 1981

[54] CORROSION-RESISTANT IRON-BASE MATERIAL AND A PROCESS FOR PRODUCING SAME

[75] Inventors: Keiji Nemoto, Kawasaki; Kyoji Takahashi, Tokyo; Hiroyuki Hayashi, Daikanyama, all of Japan

[73] Assignee: Director General of Agency of Industrial Science and Technology, Tokyo, Japan

[21] Appl. No.: 942,190

[22] Filed: Sep. 14, 1978

[30] Foreign Application Priority Data

Jan. 28, 1978 [JP] Japan ..... 53/8536

[51] Int. Cl.[3] ..... B05D 3/12; B05D 3/02; B32B 15/00

[52] U.S. Cl. ..... 428/660; 427/350; 427/376.8; 428/681

[58] Field of Search ..... 427/350, 375, 388 C, 427/388 D, 376.8; 428/457, 660, 681

[56] References Cited

U.S. PATENT DOCUMENTS

| | | | |
|---|---|---|---|
| 2,998,642 | 9/1961 | McCawley | 428/660 |
| 3,083,448 | 4/1963 | Moore et al. | 428/660 X |
| 3,505,094 | 4/1970 | Arutunian | 428/660 X |
| 4,027,367 | 6/1977 | Rondeau | 428/660 X |

FOREIGN PATENT DOCUMENTS

| | | | |
|---|---|---|---|
| 49-80163 | 1/1974 | Japan | 427/350 |
| 51-90400 | 2/1976 | Japan | 427/350 |

*Primary Examiner*—Michael R. Lusignan

[57] ABSTRACT

A corrosion-resistant iron-base material coated on at least a part of the surface thereof with a layer of a titanium-nickel alloy containing 5–45% by weight of nickel. This corrosion-resistant iron-base material is produced by applying a viscous coating liquid containing titanium powder, nickel powder and a binder onto the surface of an iron-base alloy and then heating the iron-base alloy at a temperature of 900°–1200° C. under vacuum so as to form on the surface thereof a layer of the titanium-nickel alloy containing 5–45% by weight of nickel.

3 Claims, 1 Drawing Figure

CORROSION-RESISTANT IRON-BASE MATERIAL AND A PROCESS FOR PRODUCING SAME

BACKGROUND OF THE INVENTION

This invention relates to a corrosion-resistant iron-base material coated on at least a part of the surface thereof with a layer of a titanium-nickel alloy as well as a process for producing same.

From the past, it is well known that a titanium coating is applied onto the surface of an iron-base material such as iron, steel or stainless steel to improve the corrosion resistance thereof. We already proposed a process for applying a titanium coating onto the surface of an iron-base material wherein a viscous coating liquid containing titanium powder and a binder is applied onto the surface of an iron-base material, dried and heated under vacuum [Japanese Patent Prov. Publn. No. 143733/Sho. 50(1975)]. A fairly good corrosion resistance was shown by the titanium layer coated on the material but was still insufficient enough to use the material as electrolytic anodes. Thus, there is a great demand for developing an iron-base material highly improved in corrosion resistance especially when used as electrolytic anodes.

BRIEF SUMMARY OF THE INVENTION

It is a prime object of the present invention to provide an iron-base material extremely enhanced in corrosion resistance.

It is another object of the present invention to provide an iron-base material coated on at least a part of the surface thereof with a layer of a titanium alloy enhanced in corrosion resistance.

It is still another object of the present invention to provide a process for producing an iron-base material coated on at least a part of the surface thereof with a layer of a titanium alloy enhanced in corrosion resistance.

Other and further objects of the present invention will become obvious upon understanding of the illustrative embodiments about to be described or will be indicated in the appended claims, and various advantages not referred to herein will occur to one skilled in the art upon employment of the present invention in practice.

DETAILED DESCRIPTION OF THE INVENTION

Figure 1:
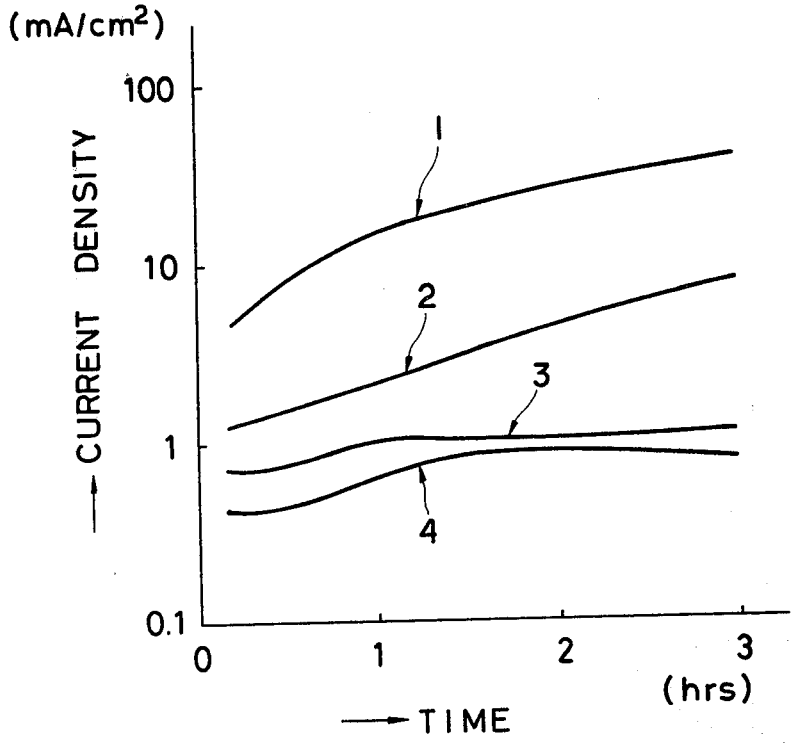

According to our study made for the purpose of improving corrosion resistance of iron-base materials coated with titanium, it was found that the coated titanium layer did not consist of homogeneous titanium but contained a heterogeneous phase of a titanium-iron intermetallic compound formed from titanium atoms and iron atoms diffused into the titanium layer from the iron-base material and that the corrosion resistance of the titanium layer was considerably damaged by the heterogeneous phase. As a result of our further study made for inhibiting the formation of the titanium-iron intermetallic compound possessing a poor corrosion resistance, it has now been found that when an iron-base material is coated with a layer of a titanium-nickel alloy containing an adequate amount of nickel in place of the titanium layer, diffusion of iron atoms from the iron-base material into the coating layer is inhibited whereby a layer of a homogeneous titanium-nickel alloy enhanced in corrosion resistance is formed. The present invention has been accomplished on the basis of the above finding.

The present invention can more fully be understood from the following description taken in conjunction with the accompanying drawing in which:

The FIGURE is a graph showing the change in density of electrolytic current in an anode polarization analysis.

The corrosion-resistant iron-base material of the present invention is coated on at least a part of the surface thereof with a layer of a titanium-nickel alloy containing 5–45% by weight of nickel, the layer being silver white in color and usually having a thickness of 10–200μ.

In the present invention, the iron-base material comprises an iron alloy, such as steel or stainless steel, besides iron itself and may be in the form of a plate, tube, cylinder, square pillar or any other suitable form.

The first step for producing the product of this invention comprises applying a various coating liquid containing titanium powder, nickel powder and a binder onto the surface of an iron-base material to be treated. In this case, the total quantity of the nickel atoms and the titanium atoms is within the range of 25–65 mg per square centimeter of the surface of the iron-base alloy. Any kind of titanium powder and nickel powder can be used so far as they are capable of forming a titanium-nickel alloy by sintering. For example, a titanium compound such as titanium hydride or a titanium halide, in particular, chloride is used in addition to titanium itself as the titanium powder, while a nickel compound such as nickel carbonyl or nickel hydride is used in addition to nickel itself as the nickel powder. These titanium powder and nickel powder are preferably as small in particle size as possible and are usually employed in the form of very fine particles capable of passing through a screen of 325 mesh. Any of the binders of organic nature such as carboxymethylcellulose, starch, dextrin, sodium alginate, polyvinyl alcohol and gum arabic are used as the binder. Water is usually employed as a solvent for preparing the coating liquid but an organic solvent alone or in mixture with water can also be used. The coating liquid preferably used in the present invention is adjusted to have a viscosity within the range of 100–300 cp, preferably 140–210 cp. The ratio of the titanium powder to the nickel powder in the preparation of the coating liquid is adjusted in such manner that the titanium atoms and the nickel atoms in the mixture may be 95–55% by weight and 5–45% by weight, respectively. In view of corrosion resistance, the mixture preferably has a nickel content of 15–25% by weight.

The method of applying a coating liquid onto the iron-base material is selected suitably from the known conventional methods including immersion, brushing, spraying and the like means, taking the shape of the iron-material into consideration. Utilizable for applying the coating liquid onto the inner surface of a pipe is, for example, a method wherein the coating liquid is uniformly spread over the inner bottom surface of the horizontally maintained pipe in the longitudinal direction thereof and then the pipe is allowed to rotate or wherein the coating liquid is supplied onto the inner surface of the pipe from the upper open end thereof while rotating the pipe kept inclined at an angle of 10°–30° to the horizontal level. In this case, the amount of the coating liquid supplied depends on the inner surface area of the pipe and on the thickness of a desired coating layer. In general, however, the coating liquid is used in an amount such that the metal powders (titanium and nickel) may be 150–200 mg per aquare centimeter of the inner surface area of the pipe. The rotation speed of the pipe varies according to the viscosity of the coating liquid used but is preferably within the range of 100–200 m per minute, preferably 140–180 m/minute in terms of periphery speed.

The iron-base material coated uniformly with the coating liquid according to the above method is then placed in a vacuum furnace and heated at a high temperature. In this case, a temperature of 900°–1200° C., preferably 1000°–1100° C. is adopted as the heating temperature. The resident time of the material in the furnace is within a period from 10 minutes to 2 hours, usually from 30 minutes to 1 hour. When the temperature is gradually elevated, the resident time may be zero minute at a slow elevation rate of temperature below 300° C. per minute. The degree of vacuum during the heating is preferably below $10^{-4}$ mmHg.

By such heat treatment, the layer of the coating liquid applied onto the surface of the iron-base material permits the volatilization of the binder contained in the liquid and at the same time the formation of a titanium-nickel alloy on the surface of the material whereby a good corrosion-resistant coating layer is obtained on the surface of the material. As fusion occurs between the iron-base material and the coating layer, the iron-titanium and iron-nickel intermetallic bonds are formed on the boundary surface, thus making the bonding force strong.

As the coating layer comprises a titanium-nickel alloy in the present invention, the corrosion resistance of the material is extremely enhanced. In the case of the coating layer free of nickel, the corrosion resistance of the material becomes inferior, as described hereinbefore, on account of a considerable amount of iron atoms diffused into the coating layer from the material. Contrary to this, in the case of the coating layer of the present invention comprising a titanium-nickel alloy, the diffusion of iron atoms into the coating layer is significantly inhibited, thus making it possible to obtain the coating layer possessing remarkably enhanced corrosion resistance.

The present invention will now be explained in more detail by way of an example, but it is to be construed that the scope of the invention is not limited to this example.

EXAMPLE

A mild steel panel (JIS G-3141, Grade 1, 1.0 mm in thickness) was cut into pieces of 20×25 mm in size and each piece was polished with an emery paper and degreased by washing successively with trichloroethylene and acetone to prepare a test piece for coating.

On the other hand, 52 parts by weight of a mixture of powdery titanium hydride and powdery nickel carbonyl each passing through a screen of 325 mesh was suspended in 100 parts by weight of a 0.4% aqueous solution of carboxymethylcellulose to prepare a coating liquid.

Next, this coating liquid was applied onto the surface of the test piece with the aid of a spray gun by reciprocally moving the gun 3–4 times from the distance of about 20 cm. The coated liquid was then dried in such manner that the coated piece was dried under vacuum at a temperature of 30°–50° C. and then allowed to stand in a desiccator kept at room temperature. The thickness of the coating layer was measured by the aid of a split beam microscope whereby it was confirmed that the thickness of the layer was almost definite and calculated as 200 μ.

The test piece thus coated was then placed in a horizontal electrical furnace and the temperature was initiated to rise when the pressure was reduced to vacuum as low as $10^{-4}$ mmHg. The temperature was elevated up to 1040° C. in about 3.5 hours and the test piece was kept at this temperature for a given period of time under vacuum below $10^{-5}$ mmHg and then cooled in a furnace.

In the above test, the time for the heat treatment at 1040° C. was 30 minutes or 60 minutes and the mixing ratio of the powdery titanium hydride to the powdery nickel carbonyl was so adjusted that the metallic nickel content might be 20, 25, 30 or 35% by weight based on a mixture of the metallic titanium and the metallic nickel.

The test piece obtained by the heat treatment was subjected to an X-ray diffraction analysis to investigate the composition of the coating layer on the surface of the test piece. A part of the test piece was cut off and the structure of the cut-away section was observed with the aid of an optical microscope. As a result of these investigations, it was found that the Ti/Fe bonds existed on around the boundary surface between the steel and the coating layer and that such Ti/Fe bonds did not exist in the middle and upper parts of the coating layer but a layer of $Ti_2Ni$ which is an alloy of titanium and nickel existed instead.

Using the above test piece, a polarization analysis to see the behavior of the coating layer to the variation of electric potential and a corrosion test to observe any corrosion on the surface of the coating layer were carried out in the following manners: The test piece was covered with a silicone resin, leaving an area of 1 $cm^2$ to be tested and was then dipped in 2-N HCl. In the hydrochloric acid, an anode polarization analysis was performed by using the test piece as anode, platinum as cathode and saturated calomel electrode as reference electrode under such condition that a potentiostat was used and a potential scanning velocity of 0.25 V/min. was adopted. During this test, the hydrochloric acid was kept at 25° C. and stirred with a stirrer. When the electric potential reached at 2.1 V, the scanning of the potential was stopped and an electric current generated at this potential value was measured. A result of the test is shown in FIG. 1 which is a graph showing the change in density of electrolytic current when the electric potential was 2.1 V in an anode polarization analysis using as anode the test piece obtained by the heat treatment conducted for 30 minutes at 1040° C. In FIG. 1, the abscissa stands for time in terms of hour and the ordinate for current density in terms of $mA/cm^2$. Curves 1, 2, 3 and 4 show the results of tests using the test pieces with the coating layers having nickel contents of 35%, 30%, 25% and 20% by weight, respectively.

Next, the electrolytic test was stopped after maintaining the electrolytic potential at 2.1 V for 3 hours. The weight loss on corrosion of the test piece was calculated by quantitative analysis of titanium and nickel dissolved in the liquid from the anode during the electrolytic test. The quantitative analysis of titanium was performed by colorimetry according to a spectrophotometric method using diantipyrylmethane, while the quantitative analysis of nickel was performed by extraction colorimetry using 1-(2-pyridyl-azo)-2-naphthol. An analysis of the liquid for determination of iron was concurrently performed but iron was not detected in all of the test pieces. A result of the test is shown in Table in connection with the sorts of test pieces used. In the Table, Comparative Example shows a result of the corrosion test using a test piece coated with a titanium layer of 200 $\mu$ in thickness which was obtained in the same manner as described above except that a coating liquid free from the nickel ingredient was used.

TABLE

| Sort of test piece | | Quantity of ions dissolved ($mg/cm^2$) | | |
|---|---|---|---|---|
| Ni content (wt. %) | Heat treatment time (mins)*1 | Ni | Ti | Total |
| 20 | 30 | 0.0115 | 0.0301 | 0.0416 |
| | 60 | 0.0140 | 0.0301 | 0.0441 |
| 25 | 30 | 0.0191 | 0.0397 | 0.0588 |
| | 60 | 0.0145 | 0.0329 | 0.0474 |
| 30 | 30 | 0.0315 | 0.0603 | 0.0918 |
| | 60 | 0.0226 | 0.0447 | 0.0673 |
| 35 | 30 | 0.2045 | 0.3579 | 0.5624 |
| | 60 | 0.1222 | 0.2027 | 0.3249 |
| Comparative | 60*2 | (0.218)*3 | 0.125 | 0.333 |
| Example | 120*2 | (0.177)*3 | 0.116 | 0.233 |

TABLE-continued

| Sort of test piece | | Quantity of ions dissolved ($mg/cm^2$) | | |
|---|---|---|---|---|
| Ni content (wt. %) | Heat treatment time (mins)*1 | Ni | Ti | Total |
| (Ti coated) | | | | |

*1The period of time kept at 1040° C.
*2The period of time kept at 1090° C.
*3The quantity of iron ions dissolved The above table obviously shows that the the coating layer comprising a titanium-nickel alloy is excellent in corrosion resistance.

As many apparently widely different embodiments of this invention may be made without departing from the spirit and scope thereof, it is to be understood that the invention is not limited to the specific embodiments thereof except as defined in the appended claims.

What is claimed is:

1. A corrosion-resistant material for use as electrodes and consisting of:

an iron-base substrate; and a layer of a titanium-nickel alloy provided over at least a portion of the surface of said substrate and containing 15 to 25 wt % nickel, balance titanium and incidental impurities.

2. The corrosion-resistant material according to claim 1, wherein said substrate consists of iron or steel.

3. The corrosion-resistant material according to claim 1, wherein said titanium-nickel alloy is derived from a mixture of powdered titanium hydride and nickel carbonyl heated at a temperature of between 1,000° and 1,100° C.

* * * * *